US005908257A

United States Patent [19]

Martin

[11] Patent Number: 5,908,257

[45] **Date of Patent: *Jun. 1, 1999**

[54] TOOTHPASTE DISPENSING TOOTHBRUSH

[76] Inventor: Todd A. Martin, 1412 Ridgeback Rd., Apt. D, Chula Vista, Calif. 91910

[21] Appl. No.: 09/149,220

[22] Filed: Sep. 8, 1998

Related U.S. Application Data

[60] Provisional application No. 60/057,793, Sep. 8, 1997.

[51] Int. Cl.[6] ..... A46B 11/02

[52] U.S. Cl. ..... 401/271; 401/175; 401/287

[58] Field of Search ..... 401/271, 175, 401/287

[56] References Cited

U.S. PATENT DOCUMENTS

| | | | |
|---|---|---|---|
| 642,114 | 1/1900 | Hall | 401/175 |
| 1,336,390 | 4/1920 | Sargery et al. | 401/175 |
| 1,578,922 | 3/1926 | Sargery . | |
| 1,836,800 | 12/1931 | Hope . | |
| 1,988,557 | 1/1935 | Jecker | 401/271 |
| 2,370,626 | 3/1945 | Heideman | 401/271 X |
| 3,141,465 | 7/1964 | Petropoulos . | |
| 3,995,648 | 12/1976 | Kuryla . | |
| 4,062,635 | 12/1977 | Teh-Sheng . | |
| 4,145,147 | 3/1979 | Schuck . | |
| 4,201,490 | 5/1980 | D'Angelo . | |
| 4,957,125 | 9/1990 | Yaneza . | |
| 5,026,191 | 6/1991 | Akly . | |
| 5,033,898 | 7/1991 | Williams | 401/287 X |
| 5,066,155 | 11/1991 | English et al. . | |
| 5,746,532 | 5/1998 | Megill et al. | 401/271 X |

FOREIGN PATENT DOCUMENTS

| | | | |
|---|---|---|---|
| 526405 | 2/1954 | Belgium . | |
| 1034682 | 7/1953 | France . | |
| 420129 | 4/1947 | Italy . | |
| 5251251 | 4/1977 | Japan | 401/175 |

*Primary Examiner*—Steven A. Bratlie

[57] ABSTRACT

A toothbrush which is adapted to contain a significant quantity of toothpaste therein and to dispense the toothpaste onto the toothbrush bristles. The toothbrush generally comprises a hollow handle having a brush head formed integrally on its top end, a disposable toothpaste containing cartridge supported within its interior, and a piston mechanism threadably attached to its bottom end. The piston mechanism is adapted to force the toothpaste out of the handle into a conduit formed through the brush head. The conduit leads from the interior of the handle to a plurality of outlet holes disposed below resilient valves in a rubber gasket layer which supports the bristles. The valves allow toothpaste to flow from the conduit onto the bristles of the toothpaste while preventing water or other fluids from flowing into the conduit to contaminate the toothpaste supply.

9 Claims, 2 Drawing Sheets

30
38
20
44
40
46
48
62
60
54
50
52
56
58
70

TOOTHPASTE DISPENSING TOOTHBRUSH

CROSS-REFERENCE TO RELATED APPLICATION

This application claims the benefit of U.S. Provisional Patent Application Ser. No. 60/057,793, filed Sep. 8, 1997.

BACKGROUND OF THE INVENTION

1. Field of the Invention

The present invention relates to a toothbrush. More specifically, the invention relates to a toothbrush which contains a significant quantity of toothpaste therein and dispenses the toothpaste onto the toothbrush bristles.

2. Description of Related Art

In many different circumstances when a person does not have access to convenient bathroom facilities, such as when traveling or camping, it is desirable to have a toothbrush which may be stored and transported with a minimum of difficulty. Additionally, it is often inconvenient at times to carry a supply of toothpaste in addition to the toothbrush. For these reasons, several toothbrushes which contain a significant supply of toothpaste therein that may be easily dispensed onto the brush head have been disclosed in the prior art.

U.S. Pat. No. 5,066,155, issued Nov. 19, 1991 to Philip H. English and Anthony D. Szpak discloses a toothbrush having a removable and disposable handle portion adapted to contain a significant quantity of toothpaste therein. The disposable handle relies on a screw driven piston mechanism to force toothpaste from the handle, through a channel formed through the brush head, and onto the bristles. A tube is located at the outlet of the channel formed through the brush head to help dispense toothpaste onto the top of the bristles and a valve helps prevent the toothpaste within the toothbrush from being contaminated.

U.S. Pat. Nos. 1,578,922, issued Mar. 30, 1926 to Joseph A. Sargery, 3,141,465, issued Jul. 24, 1964 to Thomas S. Petropoulos, and Belgium Patent number 526,405, issued Feb. 27, 1954, disclose toothbrushes which are adapted to have a toothpaste containing cartridge placed within the handle thereof. All three toothbrushes rely on a screw driven piston mechanism to force the toothpaste out of the cartridge, through a channel in the brush head, and onto the bristles of the toothbrush.

U.S. Pat. No. 4,957,125, issued Sep. 18, 1990 to Merle L. Yaneza, discloses a toothbrush having a handle adapted to be filled with a significant quantity of toothpaste and a screw driven piston mechanism adapted to force the toothpaste through a hole in the top of the handle. The brush head of the toothbrush threadably attaches to the top of the handle to seal the toothpaste dispensing hole therein and a floss dispensing mechanism is fixedly attached to the bottom of the handle.

U.S. Pat. No. 3,995,648, issued Dec. 7, 1976 to Michael A. Kuryla, and French Patent Number 1,034,682, issued Jul. 29, 1953, disclose toothbrushes having hollow handles adapted to contain a significant quantity of toothpaste therein and screw driven piston mechanisms adapted to force the toothpaste through a channel in the brush head and onto the bristles of the toothbrush. The screw driven piston mechanisms of the both toothbrushes may be removed from within the handle to allow the handle to be refilled with toothpaste.

U.S. Pat. Nos. 4,145,147, issued Mar. 20, 1979 to Joseph T. Schuck, 4,201,490, issued May 6, 1980 to Augustino D'Angelo, and 5,026,191, issued Jun. 25, 1991 to Cesar Akly disclose toothbrushes which contain significant quantities of toothpaste in hollow handle portions and which utilize screw driven piston mechanisms to force the toothpaste through a channel in the brush head and onto the bristles of the toothbrush. None of the toothbrushes mentioned above are adapted to be refilled.

U.S. Pat. No. 4,062,635, issued Dec. 13, 1977 to Wu Teh-Sheng, and Italian Patent Number 420,129 issued Apr. 16, 1947, disclose toothpaste dispensing toothbrushes which dispense toothpaste from a reservoir within the toothbrush handle onto the bristles of the toothbrush. The toothbrushes mentioned above both rely on a directly driven piston to dispense the toothpaste contained therein.

However, none of the prior art discloses a toothbrush which has a hollow handle adapted to receive a disposable toothpaste cartridge therein, a screw driven piston mechanism for forcing the toothpaste from the handle, and a plurality of elastic valves regulating the flow of toothpaste onto the bristles of the brush head.

None of the above inventions and patents, taken either singly or in combination, is seen to describe the instant invention as claimed.

SUMMARY OF THE INVENTION

The present invention is a toothbrush which is adapted to contain a significant quantity of toothpaste therein and to dispense the toothpaste onto the toothbrush bristles. The toothbrush generally comprises a hollow handle having a brush head formed integrally on its top end, a disposable toothpaste containing cartridge supported within its interior, and a piston mechanism threadably attached to its bottom end. The piston mechanism extends into the interior of the handle and through the toothpaste cartridge so that a screw driven piston may be actuated to force the toothpaste out of the handle into a conduit formed through the brush head. The conduit leads from the interior of the handle to a plurality of outlet holes disposed below a rubber gasket layer which supports the bristles. Resilient valves adapted to be opened by the expressive force of the toothpaste flowing through the conduit are formed in the gasket layer over each outlet. The valves allow toothpaste to flow from the conduit onto the bristles of the toothbrush while preventing water or other fluids from flowing into the conduit to contaminate the toothpaste supply. A removable cap may also be included to keep the brush head clean when not in use.

The handle and the toothpaste containing cartridge may be made partially or completely from transparent materials to allow the level of toothpaste within the handle and the cartridge to be easily checked. When the cartridge is empty, the piston mechanism may easily be unscrewed from the bottom of the handle so that the cartridge may be removed and replaced by a fresh cartridge.

Accordingly, it is a principal object of the invention to provide a toothpaste dispensing toothbrush which may be easily stored and transported.

It is another object of the invention to toothpaste dispensing toothbrush which allows the level of toothpaste contained therein to be easily checked.

It is a further object of the invention to provide a toothpaste dispensing toothbrush which utilizes disposable toothpaste containing cartridges to refill the toothbrush with toothpaste.

Still another object of the invention is to provide a toothpaste dispensing toothbrush which prevents the supply of toothpaste contained therein from being contaminated by external fluids.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
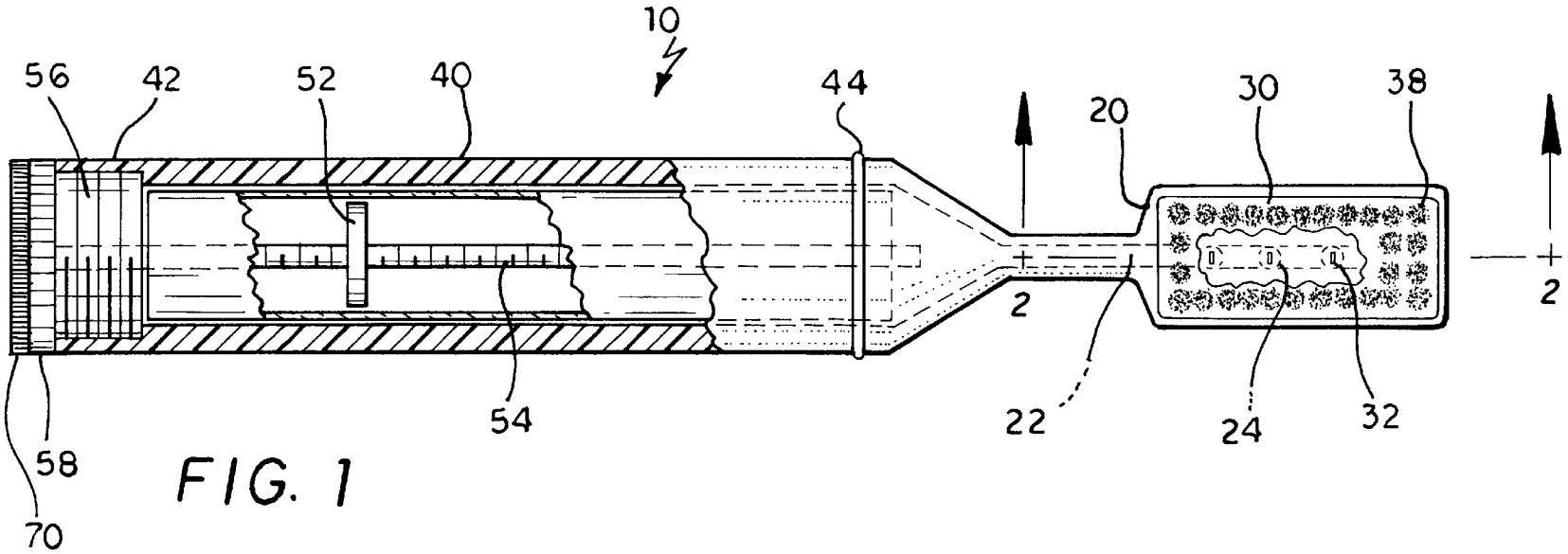
FIG. 1 is a partially cut away plan view of the toothpaste dispensing toothbrush of the present invention.
Figure 3:
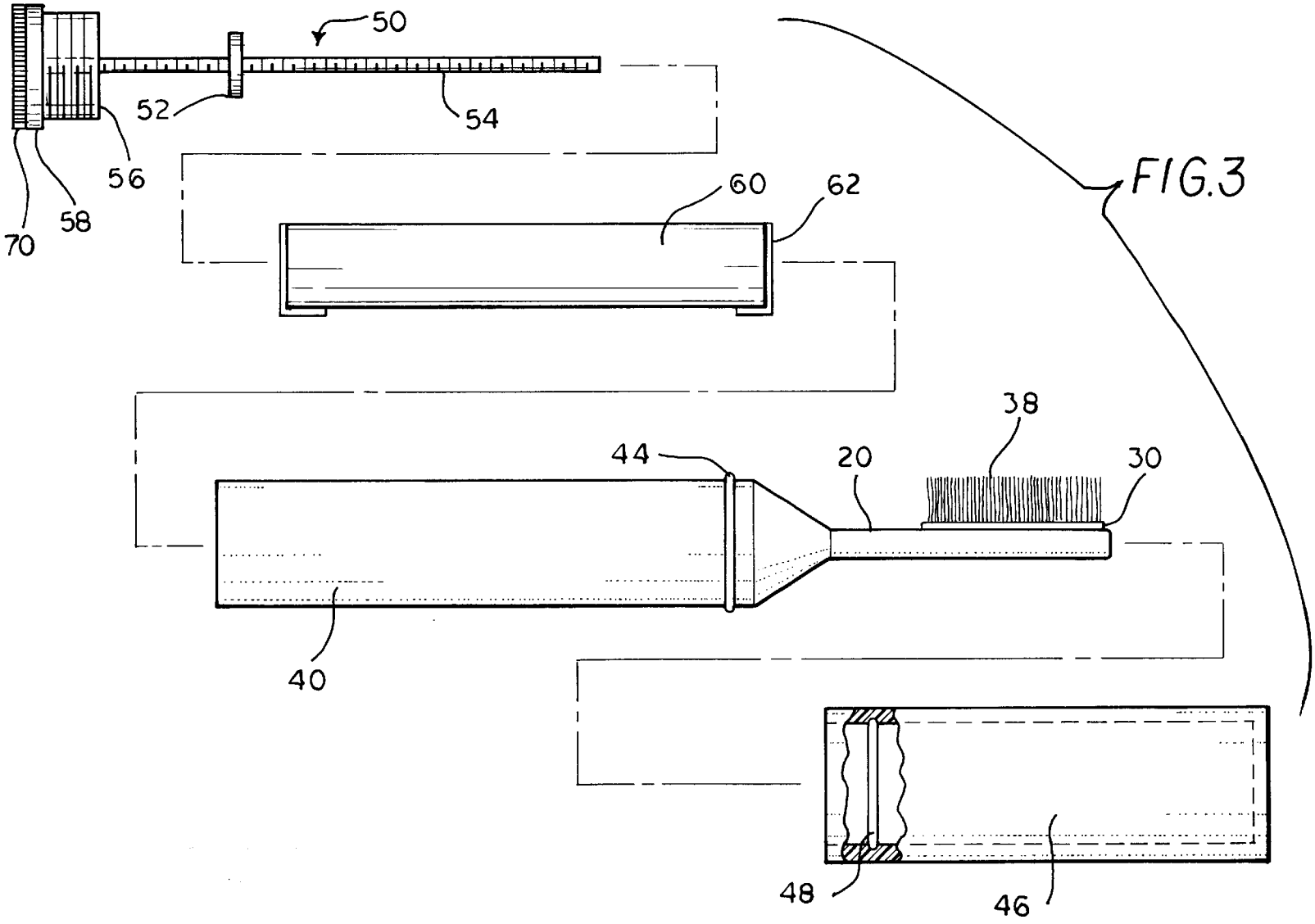
FIG. 3 is an exploded view of the toothpaste dispensing toothbrush of the present invention.

Referring to the drawings, FIGS. 1 and 3 illustrates the toothbrush 10 of the present invention which is adapted to contain and dispense a significant quantity of toothpaste. The toothbrush 10 generally comprises a brush head 30, a handle 40, a cap 46, a piston mechanism 50, and a toothpaste cartridge 60.

The handle 40 preferably forms an elongate shell which is adapted to contain a significant quantity of toothpaste therein and which is open at its bottom end. The interior surface of the handle 40 has a cylindrical threaded portion 42 formed thereon adjacent the bottom end thereof to provide a means of securing the piston mechanism 50 thereto. The exterior surface of the handle 40 has a rib 44 formed thereon adjacent the top end thereof to provide a means of securing the cap 46 thereon.

The brush head 20 is formed integrally on the top end of the handle 40 so that a conduit 22 formed through the brush head 20 along the longitudinal axis thereof is in communication with the interior of the handle 40. The conduit 20 leads from the bottom end of the brush head 20 to a plurality of outlet holes 24 formed through the brush head 20 from the front surface thereof to the conduit 22. Preferably the outlet holes 24 are formed at regular intervals along the front surface of the brush head 20 so that toothpaste will be dispensed evenly along the length of the brush head.

Figure 2:
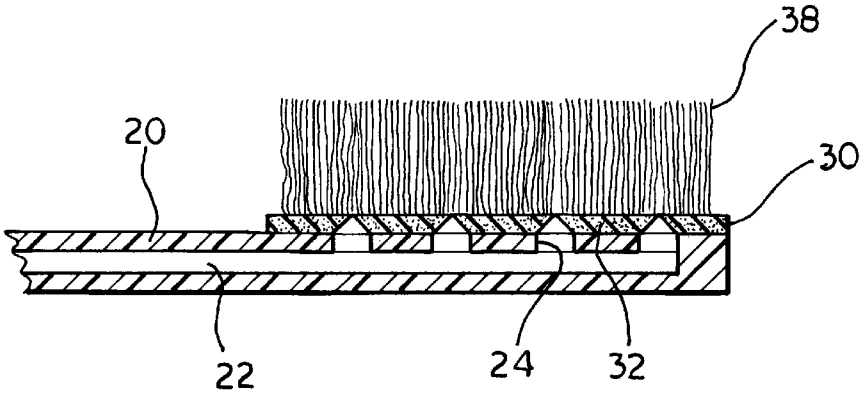
FIG. 2 is a cross sectional view of the brush head of the toothbrush taken along line 2—2 of FIG. 1.

Secured to the front surface of the brush head 20 over the outlet holes 24 is a gasket layer 30 formed of an elastic material. The gasket layer 30 has a plurality of elastic valves 32 formed therein and a plurality of bristles 38 fixedly attached thereto. An elastic valve 32 is formed in the gasket layer 30 above each outlet hole 24. This is illustrate in FIG. 2. The elastic valves 32 are preferably in the form of flapper type valves which have opposing lips which are normally biased to a closed or sealed position. In this arrangement, the opposing lips of the elastic valves 32 will be opened to allow a quantity of toothpaste to be dispensed into the bristles 38 when an expressive force is applied to toothpaste in the conduit 22.

In order to keep the brush head 20 clean and to protect it from damage, the cap 46 is adapted to be attached to the top end of the handle 40 over the brush head 20. The cap 46 is preferably an elongate shell having an inner width slightly larger than the outer width of the handle 40 and having a longitudinal length slightly greater than the length of the brush head 20. The cap 46 is open at its bottom end to receive the brush head 20 and handle 40, and closed at its top so that the brush head 20 is enclosed by the cap 46 when it is placed on the top of the handle 40. In order to secure the cap 46 on the top of the handle 40, a groove 48 adapted to interfit with the rib 44 is formed in the inner surface of the cap 46 adjacent the bottom end thereof. This can be seen in FIG. 3.

The toothpaste cartridge 60 is in the form of an elongate hollow shell which is preferably prefilled with a significant quantity of toothpaste to provide a supply of toothpaste for dispensing. The toothpaste cartridge 60 may have any shape, provided that the interior portion of handle 40 has the same shape, and provided that the shape is not perfectly circular in cross section. The toothpaste cartridge 60 has an outer width slightly smaller than the inner width of the handle 40 and a longitudinal length slightly less than that of the interior portion of handle 40 so that the toothpaste cartridge 60 may be placed within the handle 40 through the bottom end thereof. In order to allow the toothpaste cartridge 60 to be packaged and sold individually as a refill unit for the toothbrush 10 of the present invention, both ends of the toothpaste cartridge 60 are open and initially sealed with removable closures 62 which are adapted to be peeled off before inserting the toothpaste cartridge 60 into the handle 40. This can also be seen in FIG. 3.

In the preferred embodiment, the toothpaste cartridge 60 is constructed of a cardboard tube to minimize cost of construction and to allow the toothpaste cartridge to be easily disposed of. In an alternate embodiment, the handle 40 and the toothpaste 60 may both be constructed at least partially of transparent materials to allow a user to easily check the level of toothpaste contained within the toothbrush 10.

Once the toothpaste cartridge 60 has been inserted into the handle 40, the piston mechanism 50 may be attached to the bottom end of the handle 40. The piston mechanism 50 generally comprises a piston 52, a screw 54, a mechanism base 56, a knob 158 nonrotatably attached to the mechanism base 56, and a rotary knob 70.

The mechanism base 56 forms an externally threaded cylinder which is adapted to be screwed into the bottom end of the handle 40 to seal the interior of the handle 40. Nonrotatable knob 58 is grasped while screwing mechanism base 56 into handle 40. When fully screwed into the bottom end of the handle 40, the bottom end of the mechanism base 56 is flush with the bottom end of the handle 40 so that a rotary knob 70 attached thereto may spin freely thereon and be easily accessed by a person using the toothbrush 10. The rotary knob 70 is attached at its radial center to the bottom end of the screw 54, which is also rotatably supported by the mechanism base 56. The screw 54 is an externally threaded elongate member which extends from the bottom end of the handle 40 to a point adjacent the top end of the handle 40.

Disposed around the screw 54 between the distal end thereof and the mechanism base 56 is the piston 52. The piston 52 forms an internally threaded plate with an outer width slightly less than the inner width of the toothpaste cartridge 60. The piston 52 may have any shape, provided that the shape corresponds to the shape of toothpaste cartridge 60 and the interior portion of handle 40, arid provided that the shape is not perfectly round. The use of a shape other than round prevents the piston 52 from rotating with respect to cartridge 60 when rotary knob 70 and screw 54 are rotated, allowing screw 54 to move piston 52 backward and forward. Forward movement of the piston 52 causes an expressive force to be applied to the toothpaste contained in the toothpaste cartridge 60, thereby urging the toothpaste through the conduit 22, the outlet holes 24, the elastic valves 32, and onto the bristles 38.

It is to be understood that the toothbrush 10 of the present invention is not limited to the embodiment described above, but encompasses any and all embodiments within the scope of the following claims.

I claim:

1. A toothpaste dispensing toothbrush comprising:

an elongate handle having a top end and a bottom end defining a longitudinal axis therebetween, said handle having a hollow interior adapted to contain a significant quantity of toothpaste, said handle being open at said bottom end thereof;

a brush head formed integrally on said top end of said handle, said brush head having a front surface, a rear surface, a top end and a bottom end, said brush head having a conduit formed therein extending from said bottom end thereof to a distance from said top end thereof, said conduit being in communication with said hollow interior of said handle, said front surface of said brush head having a plurality outlet holes formed therein, each of said outlet holes being in communication with said conduit;

a gasket layer formed of a material having a resilient memory, said gasket layer having a front surface and a rear surface, said rear surface of said gasket layer being secured to said front surface of said brush head, said front surface of said gasket layer having plurality of bristles extending therefrom, said gasket layer having plurality of elastic valves formed therein, each of said elastic valves being in communication with one of said outlet holes, said elastic valves being biased to a normally closed position, said elastic valves being adapted to open when an expressive force is applied to toothpaste within said conduit;

a piston mechanism adapted to apply an expressive force on toothpaste within said interior of said handle to urge quantities of toothpaste through said handle, said conduit, said outlet holes, said elastic valves, and onto said bristles, said piston mechanism being removably attached to said bottom end of said handle to seal said interior of said handle.

2. The toothpaste dispensing toothbrush as defined in claim 1 wherein said handle is made at least partially of a transparent material.

3. The toothpaste dispensing toothbrush according to claim 1, including:

a toothpaste cartridge adapted to be placed in said hollow interior of said handle through said bottom end of said handle to provide a simple means of filling and refilling said handle with a quantity of toothpaste, said toothpaste cartridge being hollow and prefilled with a significant quantity of toothpaste, said toothpaste cartridge having a top end and a bottom end defining a longitudinal axis therebetween, said toothpaste cartridge having a closure removably attached to said top end and said bottom end of said cartridge to seal the toothpaste therein, said toothpaste cartridge being adapted to receive said piston mechanism therethrough.

4. The toothpaste dispensing toothbrush as defined in claim 3 wherein said handle and said toothpaste cartridge are each made at least partially of a transparent material.

5. The toothpaste dispensing toothbrush as defined in claim 3 wherein said toothpaste cartridge is formed of cardboard tubing.

6. The toothpaste dispensing toothbrush as defined in claim 1 wherein said piston mechanism comprises:

a mechanism base adapted to be removably attached to said bottom end of said handle to seal said interior of said handle, said mechanism base having a top end and a bottom end, said top end being disposed within said interior of said handle when attached to said bottom end of said handle;

a knob rotatably supported on said bottom end of said mechanism base;

an elongate screw rotatably supported by said mechanism base, said screw extending from said bottom end of said mechanism base to a point adjacent said top end of said handle when said mechanism base is attached to said bottom end of said handle, said screw being attached to said knob for rotation of said screw;

a piston having an internally threaded hole formed therethrough, said piston being adapted to apply an expressive force on toothpaste within said handle when urged forward within said handle, said piston being disposed around said screw, and means for preventing rotation of said piston with respect to said handle.

7. The toothpaste dispensing toothbrush as defined in claim 6, wherein the means for preventing rotation of said piston with respect to said handle is an interior portion of said handle having a noncircular cross sectional shape, and said piston having a corresponding shape.

8. The toothpaste dispensing toothbrush as defined in claim 6 wherein said interior of said handle adjacent said bottom end thereof is internally threaded and said mechanism base is externally threaded, said bottom end threadably receiving said mechanism base.

9. The toothpaste dispensing toothbrush as defined in claim 1 further including a cap adapted to be placed over said brush head and secured to said handle.

* * * * *